United States Patent [19]

Leibowitz

[11] Patent Number: 4,998,367

[45] Date of Patent: Mar. 12, 1991

[54] COMPOUND GRIP FOR HANDGUNS

[76] Inventor: Joel Leibowitz, 26 W87th St., New York, N.Y. 10024

[21] Appl. No.: 465,332

[22] Filed: Jan. 12, 1990

[51] Int. Cl.[5] ..... F41C 23/06; F41C 23/10

[52] U.S. Cl. ..... 42/71.02; 42/74

[58] Field of Search ..... 42/71.02, 74, 71.01

[56] References Cited

U.S. PATENT DOCUMENTS

| | | |
|---|---|---|
| 544,269 | 8/1895 | Winters . |
| 779,461 | 1/1905 | Benton . |
| 837,455 | 12/1906 | Duncan . |
| 837,601 | 12/1906 | Behr . |
| 1,209,726 | 12/1916 | Krueger . |
| 2,308,627 | 1/1943 | Rickenbacher . |
| 2,438,142 | 3/1948 | Brower . |
| 3,011,283 | 12/1961 | Lunn et al. . |
| 3,023,527 | 3/1962 | Leek et al. . |
| 3,335,515 | 8/1967 | Bennett . |
| 3,696,544 | 10/1972 | Webb . |
| 4,674,216 | 6/1987 | Ruger et al. . |
| 4,771,562 | 9/1988 | Ruger . |

FOREIGN PATENT DOCUMENTS 7269 of 1895 United Kingdom ..... 42/74

OTHER PUBLICATIONS

Shooting Times & Country Magazine, Sep. 22, 1966, p. 1224.

*Primary Examiner*—Charles T. Jordan
*Assistant Examiner*—Richard W. Wendtland
*Attorney, Agent, or Firm*—Bernard Malina

[57] ABSTRACT

A compound grip for handguns for delaying, redirecting and absorbing shock produced after firing attaches to the rear frame portion of the handgun adjacent the trigger guard. The compound grip includes an elastomeric base, a pair of palmpiece inserts and alignment finger rests. The base also includes one or more fluid filled bags rearward of the rear frame portion of the handgun. A pair of mirror image palmpiece inserts each include an embedded gel sac which delays the aftershock forces. Upon firing of the handgun, the gel sac delays the aftershock forces, the fluid-filled bags absorbs these forces and redirects them, the elastomeric finger rests maintain realignment of the handgun, and the palmpiece inserts retain adequate "feel" of the handgun.

22 Claims, 2 Drawing Sheets

COMPOUND GRIP FOR HANDGUNS

BACKGROUND OF THE INVENTION

1. Field of the Invention

This invention relates to grips to be mounted to the handle of pistols, and more particularly, to shock absorbing grips which more accurately maintain line-of-fire than those grips presently known.

2. Disclosure Information Statement

In the past, handgun grips have been made of wood, molded rigid plastics, and a variety of decorative materials, including mother of pearl and special craft materials including ivory, whalebone, and rare woods. However, more recently, attention has been focused on more functional aspects of gun grips with various shock dissipating structures. While several handgun grip structures are now made from rubber or Neoprene having various degrees of hardness, none of them were in combinations which dissipate shock and maintain the "feel" of the handgun.

A prior art search uncovered the following patents:

| U.S. Pat. No. | Inventor (Assignee) | Date of Issue |
|---|---|---|
| 4,692,450 | Hoenig/Packmayr | 7/29/86 |
| 4,542,066 | Delzant/Glaverbel | 9/17/85 |
| 4,516,346 | Farrar, Cupp/Packmayr | 5/14/85 |
| 4,514,922 | Farrar, Cupp/Packmayr | 5/7/85 |
| 4,502,238 | Farrar, et al/Packmayr | 3/5/85 |
| 4,483,060 | Farrar, Cupp/Packmayr | 11/20/84 |
| 4,397,109 | Pachmayr, Farrar/Pachmayr | 8/9/83 |
| 4,378,651 | Pachmayr, Farrar/Pachmayr | 4/5/83 |
| 4,359,833 | Pachmayr, Farrar/Pachmayr | 11/23/82 |
| 4,328,633 | Pachmayr, Farrar/Pachmayr | 5/11/82 |
| 4,315,379 | Lang | 2/16/82 |
| 4,286,401 | Pachmayr, Farrar/Pachmayr | 9/1/81 |
| 4,242,824 | Pachmayr, Farrar/Pachmayr | 1/6/81 |
| 4,148,149 | Pachmayr, Farrar/Pachmayr | 4/10/79 |
| 4,132,024 | Pachmayr, Farrar/Pachmayr | 1/2/79 |
| 3,815,270 | Pachmayr/Pachmayr | 6/11/74 |
| 3,672,084 | Pachmayr/Mershon | 6/27/72 |
| 1,403,133 | Stokke | 1/10/22 |
| 621,747 | Browning | 3/21/1899 |
| 522,334 | Sanger | 12/31/1895 |
| Des271,229 | Pachmayr/Farrar/Pachmayr | 11/1/83 |
| Des269,895 | Bianchi et al/Bianchi | |

Of the patents uncovered, a search evaluation called attention to the structural features of U.S. Pat. Nos. 3,672,084 and 3,815,270, but these features did not teach the embodiments included herein. The remaining patents proved to be of interest only.

SUMMARY

This application discloses a compound grip for handguns which is designed for attachment to the rear frame portion of the handgun and also which is adjacent to the trigger guard of the handgun. The compound grip combines an elastomeric base, a pair of palmpiece inserts, and alignment finger rests. The elastomeric base is coextensive with right and left sides of said rear frame portion and extends rearward from the rear frame portion. The elastomeric base portion also includes at least one fluid-filled bag rearward of the rear frame portion of the handgun. The fluid-filled bags, which may be filled with air, nitrogen or suitable liquids, absorb aftershock forces present after the firing of the handgun. The pair of palmpiece inserts are mirror images of each other and are attached to and extend into the elastomeric base. One of the pair of palmpiece inserts is on the right outer portion of the compound grip and the other is on the left outer portion. Each palmpiece insert includes a gel sac embedded within the central inner portion which, upon firing of the handgun, delays the aftershock forces. At least two elastomeric finger rests are attached to the compound grip in the area below the trigger guard of the handgun. The compound grip, upon firing of the handgun, functions so that the gel sac delays the after shock forces, the fluid-filled bag absorbs the after shock forces, the elastomeric finger rests aid re-alignment of the handgun, and the palmpiece inserts retain adequate "feel" of the handgun.

OBJECTS AND FEATURES OF THE INVENTION

From the following several objects and features of the invention are presented. These are intended as exemplary, and not as exhaustive.

It is an object of the present invention to provide a compound grip for handguns which absorbs shock yet enables retention of the "feel" of the handgun.

It is another object of the present invention to provide a compound grip for handguns which coherently redirects forces from firing of the handgun to enable efficient recovery.

It is yet another object of the present invention to provide a compound grip for handguns which utilizes advanced shock absorption and directing techniques available through new materials and studies.

It is a feature of the present invention to include in the compound grip for handguns a nitrogen-containing bag and gel sacs.

It is another feature of the present invention to include in the compound grip for handguns a palmpiece employing a composite material, namely, a graphite-fiber-resin composite.

It is yet another feature of the present invention to include in the compound grip for handguns at least one bag configured to enhance the distribution of firing aftershocks.

BRIEF DESCRIPTION OF THE DRAWINGS

In the drawings, the descriptions of which follow, similar parts in drawings of the same embodiment bear the same reference numerals.

DESCRIPTION OF THE PREFERRED EMBODIMENTS

Figure 1:
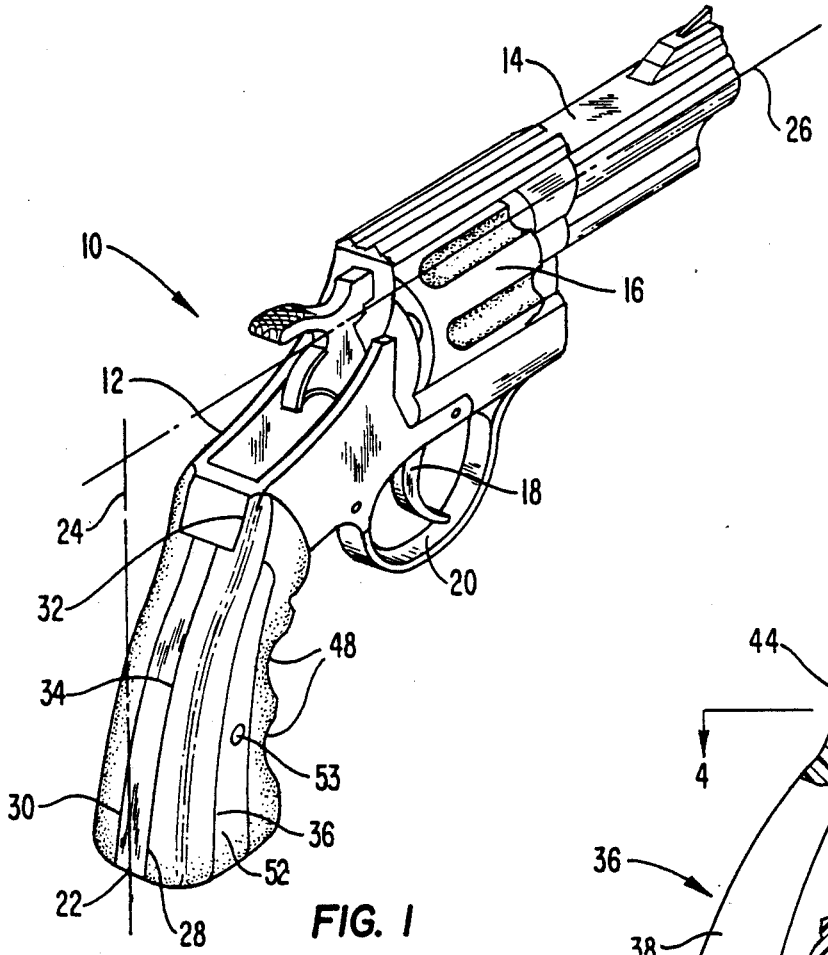
FIG. 1 is a perspective view of a handgun with the compound grip of this invention mounted thereon.
Figure 2:
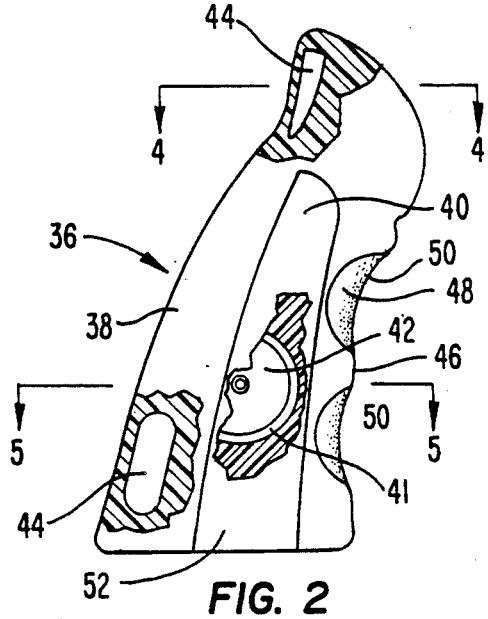
FIG. 2 is an exterior side elevational view of the right side of the compound grip partially cutaway to reveal the air bag and the gel sacs.
Figure 3:
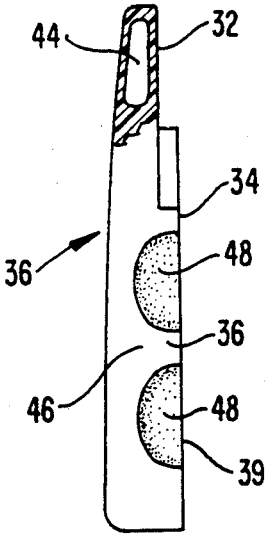
FIG. 3 is a front view of the grip (not mounted on the handgun) showing the finger rest portions.
Figure 4:
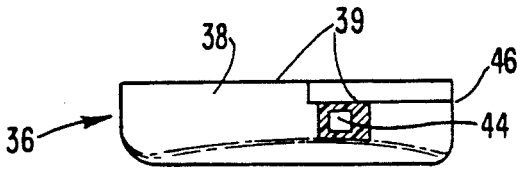
FIG. 4 is a cross-sectional view taken along line 4—4 of FIG. 2.
Figure 5:
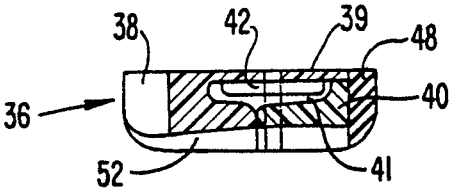
FIG. 5 is a cross-sectional view taken along line 5—5 of FIG. 2.
Figure 6:
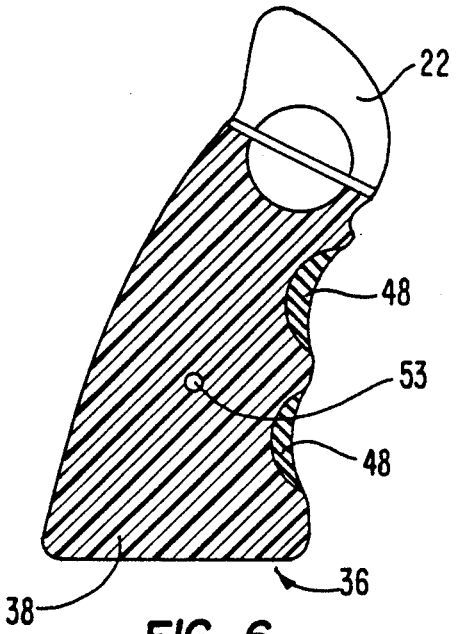
FIG. 6 is a side elevational view of the left side of the compound grip.
Figure 7:
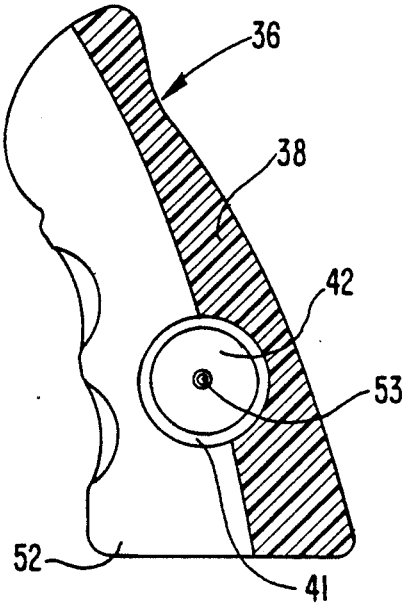
FIG. 7 is an interior side elevational view of the right side of the compound grip partially cutaway to reveal the air bag and the gel sacs.
Figure 8:
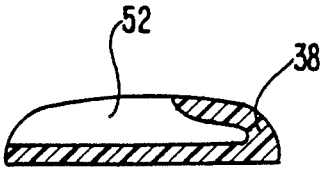
FIG. 8 is a bottom view of the compound grip portion shown in FIGS. 2 and 7.

The handgun or revolver shown in FIG. 1 is generally referred to by the reference numeral 10. The handgun 10 has a frame 12, constructed of metal, and mounted thereon a barrel 14 and an ammunition chamber 16. Below the barrel 14, there is a trigger 18 and an associated trigger loop or guard 20 about trigger 18.

At the anterior end of handgun 10, the frame 12 has a handle portion or is formed into a handle 22 which extends rearwardly and downwardly from behind the chamber 16. The handle or rear frame portion 22 of the frame 12 (as yet unadorned by the grip of this invention) is a substantially flat, plate like body disposed so that the central plane 24 thereof is one which also includes the longitudinal axis 26 of the barrel 14. For purposes of this description, the face of the handle portion 22 of the frame 12 which is on the right side of the gun held in the firing position is called the right side or face 28 and the opposite face, the left side or face 30. For similar convenience, the terms "upper", "lower", "front", and "rear" are applied to the gun held in the firing position with "upper" being adjacent the barrel 14 and "front" being toward the open end of the barrel 14. These positional/-locational descriptors are also applied to the shock absorbing grip of this invention described hereinbelow. The handle portion 22 is constructed to include an upper aperture 32 in the upper, central portion thereof and a lower aperture 34 in the lower, central portion thereof.

Referring now to FIGS. 2 through 8, a compound grip 36 of this invention is shown mounted on a handgun 10. While the handgun 10 is typical of those to which the grip 36 may be attached, the grip 36 may be adapted to a broad range of handguns having handle portions similar to handle portion 22 of frame 12. The compound grip 36 has a base pad 38, preferably constructed of a soft rubber or Neoprene having a hardness of 40 durometer (approximate). On the right side, the right interior face or inner portion 39 of the grip 36 is shaped or molded to correspond to the right face 28 of the handle portion 22. The base pad 38 is provided with a graphite-fiber-resin composite or ceramic/graphite composite palmpiece insert 40 housed within the palmpiece cavity 41. In turn, a centrally located gel sac or cavity 42 is provided in palmpiece insert 40 and one or more fluid-filled bags or cavities 44 rearward of cavity 41. The gel sac or cavity 42 is constructed to receive a gelatinous material such as glycerine. It has been found that the best results are achieved by filling the gel sac 42 to 80% of capacity. Similarly, the studies have shown that filling the air bag cavities or fluid filled bags 44 with nitrogen is preferable than filling the same with air. The forward edge 46 of base pad 38 is configured into a finger rest 48 with a set of corresponding indentions or concavities 50 for middle and ring finger of the operator, each of said concavities 50 being filled with rubber or Neoprene having a hardness of 40 durometer (approximate). Into the palmpiece cavity 42, a palmpiece 52 is fitted. While this may be constructed to standard decorative materials, referred to in the Background of the Invention, supra, in the best mode of practicing this invention, the use of a graphite-fiber-resin composite material, namely, Thornel® ACS material (Thornel is a trademark of Union Carbide Corporation, Specialty Polymers and Composite Division, Chicago, Ill. 60606). This material is an advanced composite system combining carbon fibers with specially enhanced cure resins—a space age material providing microcrack resistance, thermal stability, shock dampening and mechanical properties for severe environments. The palmpiece 52 is attached to the frame 12 through an escutcheon 53 which is, in turn, constructed of nylon or Neoprene to serve as a shock barrier. The outer portion or surface 54 of palmpiece 52 is optionally tooled or carve 56 to provide greater tactile sensitivity or to improve the aesthetics of the handgun.

In operation, upon firing of a handgun aftershock forces are experienced, which forces tend to misalign or "kick up" the forward end of the handgun barrel. In a handgun equipped with the hereinabove grip, these forces are transmitted rearwardly through the frame of the handgun and first impinge upon gel sac 42. Upon such impingement, the aftershock forces are delayed, but not absorbed. The delay feature enables, especially slower ammunition, to "get away" from the handgun before the aftershock is experienced. The aftershock forces, after delay at gel sac 42 next come upon upper fluid-filled bags 44 whereupon the forces are absorbed and redirected, and, in turn, come upon lower fluid-filled bags 44 whereupon the forces are further absorbed. This absorption enables the operator to more readily align the handgun once again. In doing so, the fingering at finger rest 48 aid the realignment of the handgun. The escutcheon 53 functions to prevent shock from traveling through the compound grip to the operator by way of a path of least resistance. The palmpiece insert 40 constructed of graphite-fiber-resin composite provides adequate grip. For the purpose of this application "adequate grip" is defined as a grip surface which is sufficiently hard so as to move across the palm without adhering thereto (as would occur with a rubber or Neoprene handle with too low a durometer rating) and is still shock absorbing, in other words, a grip which maintains the "feel" of the weapon.

Small adjustments and changes may be made to the compound grip for handguns of this invention by those skilled in the art; however, such changes would be within the scope of the claims which follow.

What is claimed is:

1. A compound grip for handguns for attachment to the rear frame portion of the handgun and adjacent to the trigger guard of the handgun comprising, in combination:

an elastomeric base coextensive with right and left sides of said rear frame portion and extending rearward thereof;

a pair of mirror-imaged palmpiece inserts attached to and extending into said elastomeric base with one of said pair of palmpiece inserts on the right outer portion of the compound grip and the other on the left outer portion, said palmpiece inserts each, in turn, further comprising:

a gel sac embedded within the central inner portion thereof for delaying the after shock forces upon firing of the handgun; and, at least two elastomeric finger rests attached to the compound grip in the area below the trigger guard of the handgun;

whereby, upon firing of the handgun, said gel sac delays the after shock forces, the elastomeric finger rests aid re-alignment of the handgun, and the palmpiece inserts retain adequate grip.

2. A compound grip for handguns as described in claim 1 wherein the elastomeric base, for optimal absorption, has a hardness of 40 durometer (approximate).

3. A compound grip for handguns as described in claim 1 wherein said gel sac is partially filled with glycerine.

4. A compound grip for handguns as described in claim 3 wherein said gel sac is 80% filled with glycerine.

5. A compound grip for handguns as described in claim 1 wherein said elastomeric base, in turn, further comprises:

at least one fluid-filled bag rearward of the rear frame portion of the handgun for absorbing aftershock forces after firing of the handgun.

6. A compound grip for handguns as described in claim 5 wherein said fluid-filled bag is filled with air.

7. A compound grip for handguns as described in claim 5 wherein said fluid-filled bag is filled with nitrogen.

8. A compound grip for handguns as described in claim 1 wherein said palmpiece inserts are graphite-fiber and resin composites to provide shock dampening, heat dissipation, and ease of directional control of the handgun.

9. A compound grip for handguns as described in claim 1 wherein said palmpiece inserts are ceramic-fiber and resin composites to provide shock dampening, heat dissipation and use of directional control.

10. A compound grip for handguns for attachment to the rear frame portion of the handgun and adjacent to the trigger guard of the handgun comprising, in combination:

an elastomeric base coextensive with right and left sides of said rear frame portion and extending rearward thereof, said elastomeric base, in turn, further comprising:

at least one fluid-filled bag rearward of the rear frame portion of the handgun for absorbing aftershock forces after firing of the handgun;

a pair of mirror-imaged palmpiece inserts attached to and extending into said elastomeric base with one of said pair of palmpiece inserts on the right outer portion of the compound grip and the other on the left outer portion;

at least two elastomeric finger rests attached to the compound grip in the area below the trigger guard of the handgun;

whereby, upon firing of the handgun, said fluid-filled bag absorbs and redirects the aftershock forces, the elastomeric finger rests aid re-alignment of the handgun, and the palmpiece inserts retain adequate grip.

11. A compound grip for handguns as described in claim 10 wherein the elastomeric base, for optimal absorption, has a hardness of 40 durometer (approximate).

12. A compound grip for handguns as described in claim 10 wherein said fluid-filled bag is filled with air.

13. A compound grip for handguns as described in claim 10 wherein said fluid-filled bag is filled with nitrogen.

14. A compound grip as described in claim 10 wherein said palmpiece inserts each further comprise a gel sac partially filled with glycerine embedded within the central inner portion of the palmpiece insert for delaying the aftershock forces upon firing of the handgun.

15. A compound grip for handguns as described in claim 14 wherein said gel sac is 80% filled with glycerine.

16. A compound grip for handguns as described in claim 10 wherein said palmpiece inserts are graphite-fiber and resin composites to provide shock dampening, heat dissipation, and ease of directional control of the handgun.

17. A compound grip for handguns as described in claim 10 wherein said palmpiece inserts are ceramic-fiber and resin composites to provide shock dampening, heat dissipation and ease of directional control.

18. A compound grip for handguns as described in claim 10 wherein said compound grip further includes an escutcheon for attaching the palmpiece inserts and the elastomeric base to the handgun, said escutcheon constructed of a shock absorbing material to provide shock dampening to resist transmission of shock to the operator of the handgun.

19. A compound grip for handguns for attachment to the rear frame portion of the handgun and adjacent to the trigger guard of the handgun comprising, in combination:

an elastomeric base coextensive with right and left sides of said rear frame portion and extending rearward thereof, said elastomeric base, in turn, further comprising:

at least one nitrogen-filled bag rearward of the rear frame portion of the handgun for absorbing aftershock forces after firing of the handgun;

a pair of mirror-imaged palmpiece inserts attached to and extending into said elastomeric base with one of said pair of palmpiece inserts on the right outer portion of the compound grip and the other on the left outer portion, said palmpiece inserts each, in turn, further comprising:

a gel sac partially filled with glycerine embedded within the central inner portion thereof for delaying the aftershock forces upon firing of the handgun; and, at least two elastomeric finger rests attached to the compound grip in the area below the trigger guard of the handgun;

whereby, upon firing of the handgun, said gel sac delays the aftershock forces, the fluid-filled bag absorbs and redirects, the aftershock forces, elastomeric finger rests aid re-alignment of the handgun, and the palmpiece inserts retain adequate grip.

20. A compound grip for handguns as described in claim 19 wherein said gel sac is 80% filled with glycerine.

21. A compound grip for handguns as described in claim 19 wherein said palmpiece inserts are graphite-fiber and resin composites to provide shock dampening, heat dissipation, and ease of directional control of the handgun.

22. A compound grip for handguns as described in claim 19 wherein the compound grip provides, upon firing, for the directional control of handguns, said handle portion is substantially flat with a central plane therethrough, said compound grip further comprising, in combination:

a pair of upper fluid-filled cavity means rearward of the handle portion of the handgun for absorbing aftershock forces after firing of the handgun, each said fluid-filled cavity extending about the outer rear of the handle portion, said fluid-filled cavity being elongated with the longitudinal axes thereof symmetrically arrayed with relation to the central plane of the handle portion;

said fluid-filled cavity means dimensioned with the uppermost portion, the portion above a medial plane, a plane medial the top and bottom thereof and normal to said central plane, having a known volumetric ratio to the lowermost portion, the portion below said medial plane, said volumetric ratio being calculated to produce a predetermined reactive force when the fluid-filled cavity means are filled with a specific fluid and when, upon firing of the handgun, subjected to specific aftershocks;

a pair of lower fluid-filled cavity means rearward of the handle portion of the handgun for absorbing aftershock forces after firing of the handgun, each said fluid-filled cavity extending about the outer rear of the handle portion, said fluid-filled cavity being adjacent and below said first fluid-filled cavity means for absorbing shock forces emitting therefrom;

whereby, upon firing of the handgun, said upper and lower fluid-filled cavity means absorb the aftershock forces and said upper fluid-filled cavity means provide a countervailing reactive force to maintain the handgun as originally aimed.

* * * * *